United States Patent [19]

Hooker

[11] 4,027,343

[45] June 7, 1977

[54] BED FRAME WITH DETACHABLE AND INTERCHANGEABLE COMPONENTS

[75] Inventor: Joe B. Hooker, Linwood, N.C.

[73] Assignee: Metal Bed Rail Company, division of Leggett & Platt, Inc., Linwood, N.C.

[22] Filed: Apr. 10, 1975

[21] Appl. No.: 567,019

[52] U.S. Cl. ..... 5/200 R

[51] Int. Cl.[2] ..... A47C 19/00

[58] Field of Search ..... 5/200 R, 200 B, 200 C, 5/201, 202, 310, 181, 184, 185, 288, 289, 286; 403/242, 230; 108/152; 248/224

[56] References Cited

UNITED STATES PATENTS

| | | | |
|---|---|---|---|
| 1,394,331 | 10/1921 | Monroe | 5/183 |
| 2,530,640 | 11/1950 | Wickman | 5/288 X |
| 2,882,535 | 4/1959 | Sands | 5/310 X |
| 2,900,647 | 8/1959 | Sands | 5/201 X |
| 3,220,363 | 11/1965 | Gingher | 108/152 X |
| 3,760,437 | 9/1973 | Hooker | 5/200 C |
| 3,761,971 | 10/1973 | Behnke | 5/200 C |
| 3,781,930 | 1/1974 | Spitz | 5/201 |
| 3,854,185 | 12/1974 | Reid | 403/242 |
| 3,871,039 | 3/1975 | Garceau | 5/200 R |

FOREIGN PATENTS OR APPLICATIONS

| | | | |
|---|---|---|---|
| 406,097 | 2/1934 | United Kingdom | 248/224 |

*Primary Examiner*—James T. McCall
*Attorney, Agent, or Firm*—Clarence A. O'Brien; Harvey B. Jacobson

[57] ABSTRACT

A bed frame constructed of detachable and interchangeable components to enable the width of the bed frame to be varied to supportingly receive standardized bedding, box springs, or the like, of different standard widths by interchanging components. Unique detachable interconnections are provided to enable assembly and disassembly of the bed frame and variation in its width without the use of tools or separate fastening clamps, nuts, bolts, or the like. The bed frame includes unique side rails of triangular seamless tubing having telescopically attached end brackets for supporting a headboard and/or footboard and a supporting leg assembly permanently attached adjacent each end of the side rails with box spring supporting clips detachably supported from the rail and leg assembly by the use of a socket in the upper end of the leg and a depending tongue on the box spring clip. The bed frame includes the use of an insertable center cross rail when arranged to support queen size bedding and an insertable center longitudinal rail when arranged to support king size bedding.

18 Claims, 9 Drawing Figures

20
10
46
14
44
76
72
18
12
22
14

64
66
30
32
22
72
74
76
10
14
44
18
46
26
24
82
80
78
84
82
85
86
12
28

74
72
10
100
98
99
14'
100
22
101
31
102
104
30'
12

44
63
62
58
61
60
48
46
42
68
64
66
12
26
28
24
40
36
38
30
33'
18
33
29
32
82
92
88
96
90
94
57
59

BED FRAME WITH DETACHABLE AND INTERCHANGEABLE COMPONENTS

BACKGROUND OF THE INVENTION

1. Field of the Invention

The present invention generally relates to a bed frame provided with detachable components enabling the width dimension of the bed frame to be varied to effectively support bedding of standardized widths with the frame employing four supporting legs and box spring retaining clips detachably connected to the side rails and projecting laterally therefrom in order to recess the side rails and supporting legs inwardly of the side edges of the box springs being supported by the frame with the cross rails including detachable connections with the side rails, the addition of a center cross rail in an arrangement for supporting queen size bedding and the insertion of longer end cross rails with supporting legs at the center thereof and a longitudinal center rail when the frame is arranged for receiving a king size box spring assembly.

2. Description of the Prior Art

Hollywood-type bed frames in which two parallel side rails are provided with leg assemblies and cross rails adjacent each end thereof and supporting brackets for attachment of headboards and/or footboards have been commercially available for many years and various patents have been issued relating to the manner in which the cross rails or end members are connected to the side rails or side frame members and the manner in which the inwardly disposed ends of the cross rails are adjustably interconnected. Also, prior patents have been granted in which insertable components are provided for enabling variation in the width dimension of the bed frame in order to support bedding of various standardized widths.

SUMMARY OF THE INVENTION

An object of the present invention is to provide a bed frame generally of rectangular configuration and provided with parallel side rails and parallel cross rails with the side rails incorporating supporting leg assemblies and end brackets and provided with detachable connection arrangements between the cross rails and side rails to enable interchange of components for positioning the side rails at different spaced relationships to enable effective support for different standardized width bedding.

Another object of the invention is to provide a bed frame in accordance with the preceding object in which the side rails are constructed of triangular seamless tubing which is of right triangular configuration having a vertical inner flange and a horizontal top flange, thus providing an inclined surface to the outer lower portion of the rail with the end brackets including a telescopic detachable connection with the corresponding end of a side rail.

A further object of the invention is to provide a bed frame incorporating a detachable box spring clip at each end of each side rail with each box spring clip projecting beyond the outer edge of the side rail to enable the side rails and supporting leg assemblies to be recessed inwardly of the side edges of the box spring supported by the bed frame.

Yet another object of the invention is to provide a bed frame in accordance with the preceding objects in which the supporting leg assembly incorporates a detachable connection with the cross rails including a vertically interlocking connection which eliminates the necessity of employing separate fasteners or tools and yet provides a rigid, tapered and frictional interlock between the cross rails and side rails.

A still further object of the invention is to provide a bed frame in accordance with the preceding objects in which interchangeable cross rails of different lengths may be provided for varying the width between the side rails and when the bed frame is arranged to receive queen size bedding, an additional centrally oriented cross rail having a central supporting leg assembly is provided to more effectively support the larger bedding, and when king size bedding is supported, longer cross rails are employed at each end of the frame in which the longer cross rails have a central supporting leg assembly and a longitudinal frame member interconnects the center portions of the longer cross rails, thereby providing a more rigid and effectively supported bed frame for larger bedding.

Still another important object of the present invention is to provide a bed frame of relatively simple and rigid construction which can be stored and transported in knockdown condition and assembled at the site of use by a customer or delivery person without requiring the use of tools nor manipulaton of external fastening devices, and the like. Additionally, the bed frame enables reduction of bed frame inventory by enabling interchange of components for varying the width dimension of the bed frame, thus maintaining the cost of delivery and setup of the bed frame at a minimum.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figures 1, 2, 3:
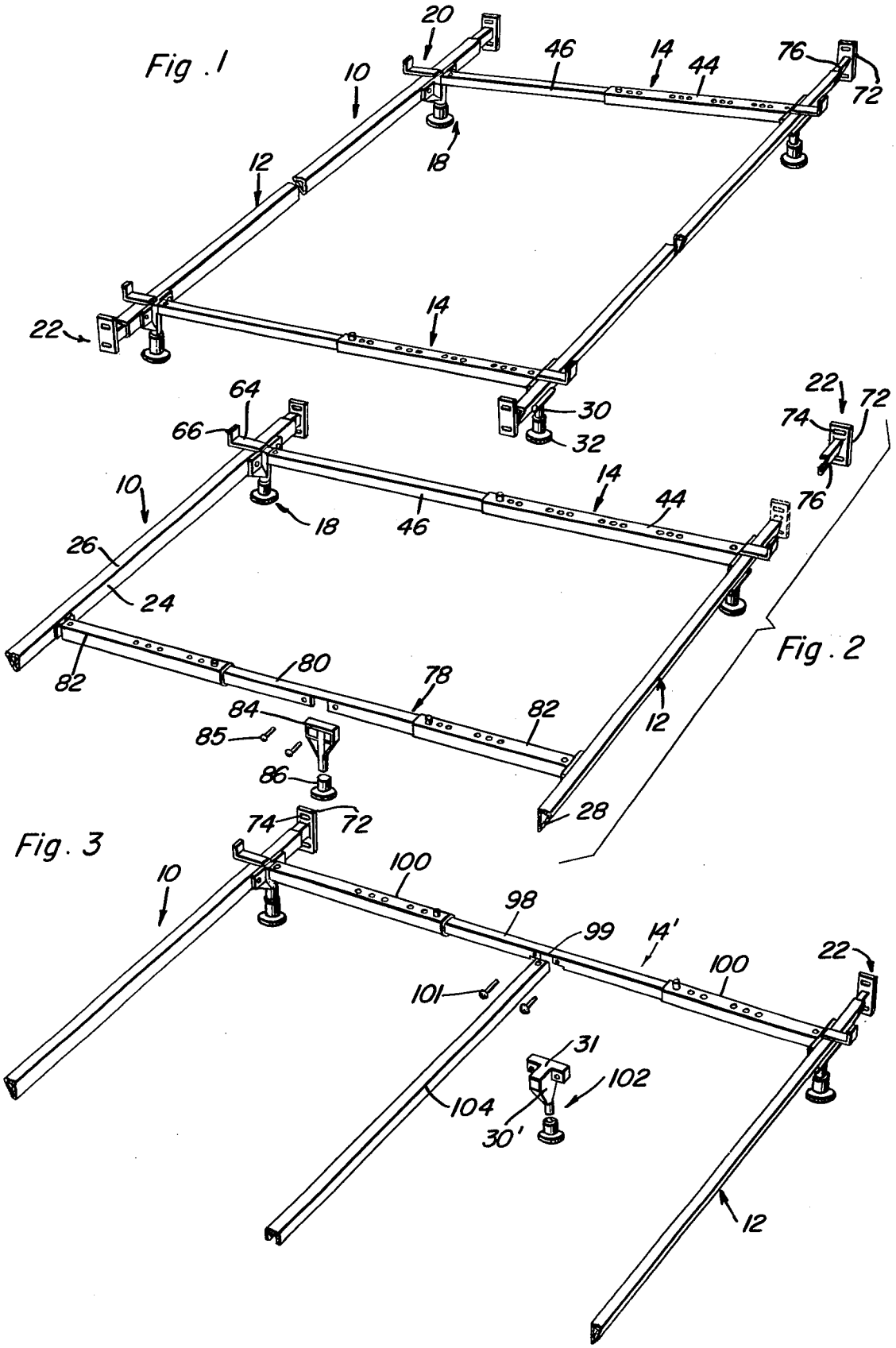
FIG. 1 is a perspective view of the bed frame arranged to support a standard single, twin or double sized bedding by interchanging the cross rails with cross rails of different lengths.
FIG. 2 is a partial perspective view of the bed frame arranged in a manner to support queen size bedding in which a center cross rail with a central supporting leg assembly thereon has been incorporated between the side rails.
FIG. 3 is a partial perspective view of the bed frame illustrating the arrangement employed for supporting king size bedding in which longer cross rails are employed with the two end cross rails having a supporting leg assembly and the central portions of the end cross rails being interconnected by a longitudinal rail parallel to the side rails.
Figure 4:
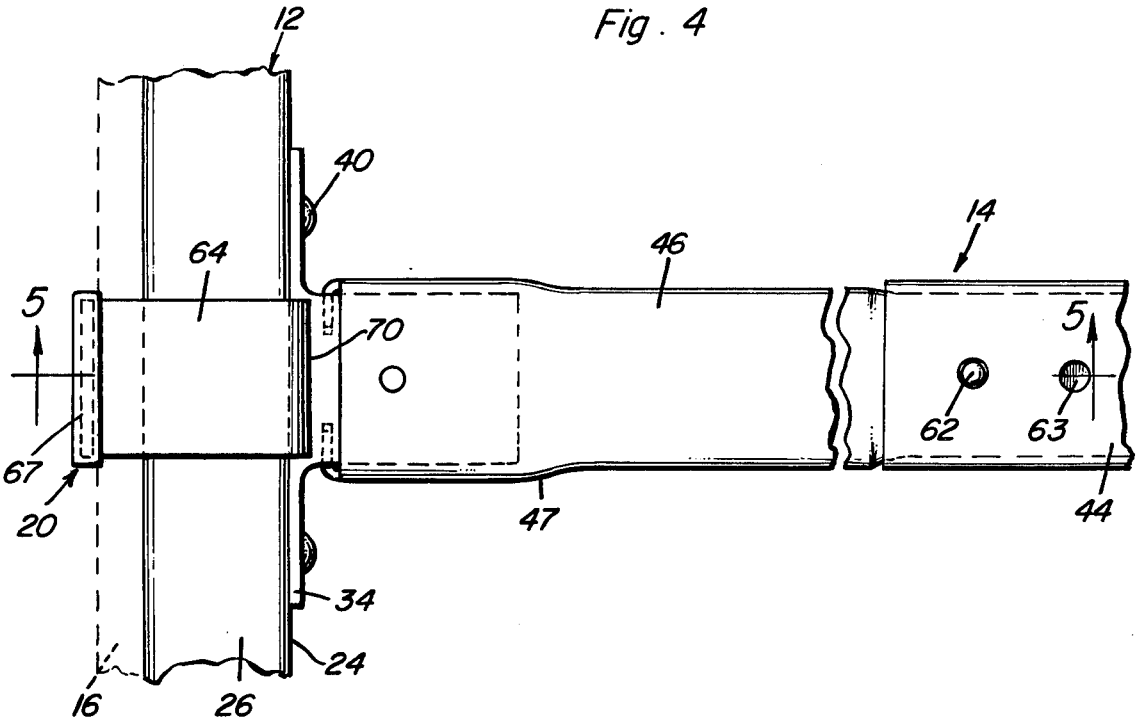
FIG. 4 is a fragmental, top plan view, on an enlarged scale, illustrating the juncture between one of the end cross rails, the leg assembly, the side rail and the mounting of the box spring clip.

The bed frame of the present invention is generally designated by the numeral 10 in FIG. 1 and includes a pair of substantially parallel side rails 12 and a pair of substantially parallel cross rails 14 interconnecting the side rails 12 and in perpendicular relation thereto with the upper surfaces of the rails 12 and 14 generally being planar for supporting bedding such as box springs 16, as illustrated in broken lines in FIG. 4. The side rails 12 are provided with supporting leg assemblies generally designated by numeral 18 at each end portion thereof and a pair of box spring clips generally designated by numeral 20 are provided on each side rail. Also, each side rail 12 may be provided with supporting bracket assemblies generally designated by numeral 22 for supporting a headboard and/or footboard (not shown).

Figures 5, 7, 8, 9:
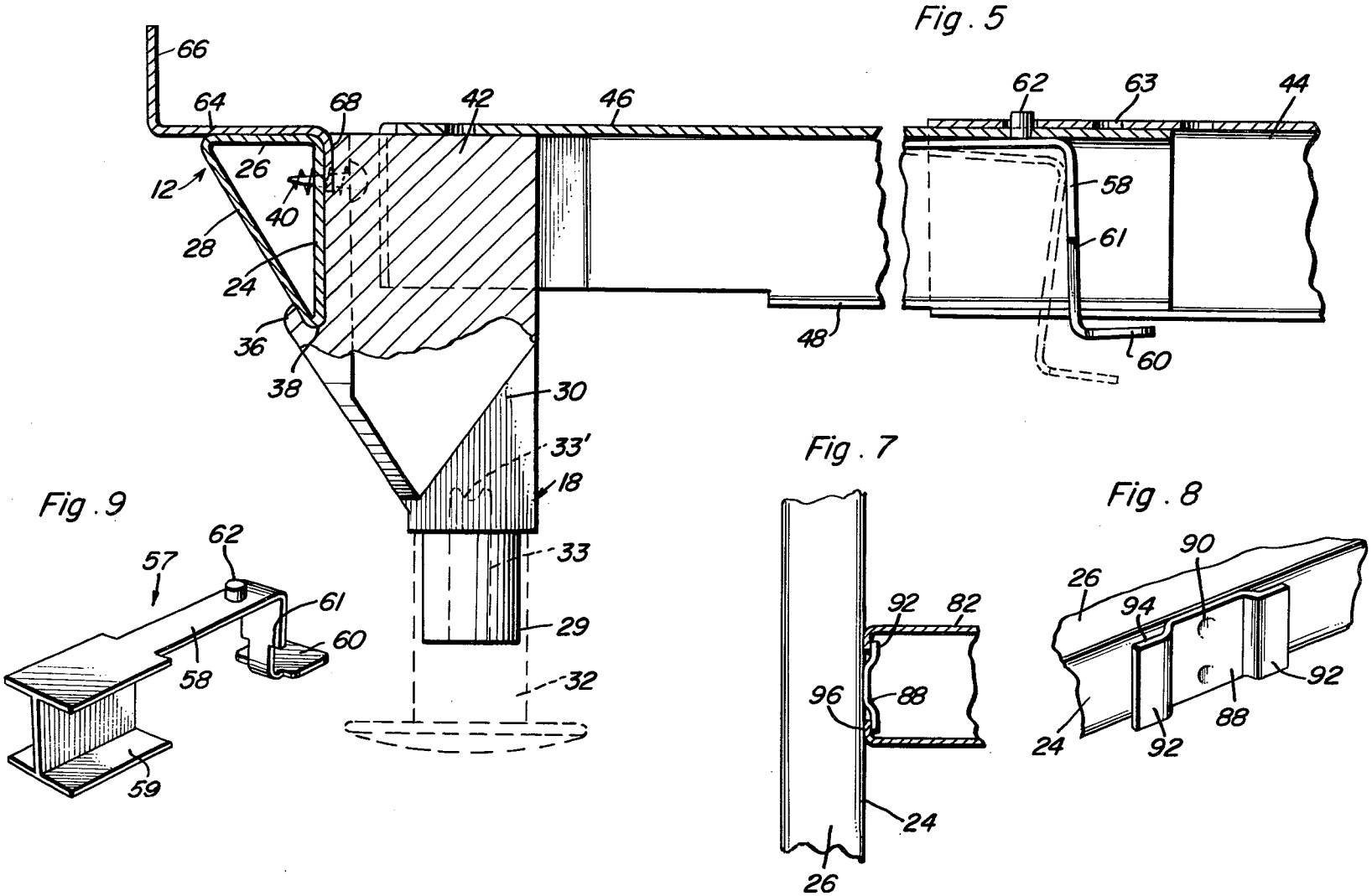
FIG. 5 is a sectional view, taken substantially upon a plane passing along section line 5—5 of FIG. 4, illustrating further structural details of this assembly.
FIG. 7 is a sectional view of the connection between the center cross rail and side rail.
FIG. 8 is a fragmental, perspective view illustrating the connecting bracket for the center cross rail or the center longitudinal rail.
FIG. 9 is a perspective view of the locking device.

As illustrated in FIG. 5, the side rail 12 is in the form of a tubing element of triangular configuration including a vertical inner flange 24, a horizontally disposed top flange 26 extending outwardly from the upper edge of the inner flange 24 and a downwardly and inwardly inclined outer flange 28 with the flanges 24, 26 and 28 being preferably of seamless construction and forming a right triangular configuration for the side rail in which the inclined flange or wall 28 forms the hypotenuse thereof and is oriented in a manner so that it eliminates a lower corner on the side frame or side rail. Thus, the triangular side rail provides a rigid angular seamless member of relatively lightweight construction and facilitates entry of implements, such as vacuum cleaner heads, or the like, under the bed frame and also eliminates the sharp lower corner which sometimes can be contacted by the ankle or shin bone area of the leg of a person making up the bed or the like.

Each leg assembly 18 includes a vertically disposed body 30 having a generally rectangular upper end portion and a downwardly tapering lower end portion having a cylindrical outer surface 29 telescopically and frictionally receiving a conventional glide 32 in a well known manner. The lower end of body 30 also includes a cavity or bore 33 provided with a depending projection 33' to receive the stem of a conventional caster. The upper and outer portion of the leg body 30 is provided with a vertically disposed and laterally extending flange 34 which has a flat surface engaging the inner surface of the flange or wall 24 of the side rail 12 as illustrated in FIGS. 4 and 5. At the lower edge of the flange 34, the body 30 is provided with a laterally outwardly extending and upwardly extending hook-shaped projection 36 which defines a notch or recess 38 conforming with and engaging the lower edge of the triangular rail 12, as illustrated in FIG. 5. The body 30 is secured to the rail 12 by fastening devices 40 which may be in the form of self-tapping screws, bolt assemblies, rivets, or any other suitable rigid connection means with the flange 34 having holes 42 formed therein to facilitate anchoring of the leg assembly to the rail 12. Such fastening devices extend through and are secured to only the inner wall or flange 24. The vertical and laterally extending flange 34 provides a relatively large surface area in engagement with the inner surface of the side rail 12 to provide lateral stability to the supporting leg assembly. The projecting hook-like structure 36 and the recess 38 further rigidifies the supporting leg assembly to prevent the lower end thereof from pivoting due to weight on the frame, which is the greatest force encountered, since the major portion of the weight of the bedding assembly and the occupants of the bed are supported by the side rails 12. The leg assembly 18 is preferably constructed of unitary rigid plastic material or may be constructed of other materials, if desired, but it has been found that plastic is relatively light in weight and has sufficient strength to support the frame, bedding and occupants.

Each of the cross rails 14 illustrated in FIGS. 1 and 2 includes two telescopic sections 44 and 46 both of which are of channel-shaped configuration with the section 44 telescopically receiving the section 46. The web of the channels is disposed upwardly and the two parallel legs thereof extend downwardly thus forming a downwardly opening channel-shaped member extending between the side rails. The bottom edges of the downwardly extending legs of the channel-shaped member defining the sections 44 and 46 are inturned as indicated by numeral 48 thus rigidifying the sections, with the inner edges of the inturned flanges 48 being spaced from each other. The remote ends of the sections 44 and 46 each have the end edges of the legs of the channel shaped section extending beyond the end edge of the web with the terminal end portion of the legs of the channel-shaped sections being turned inwardly as indicated by numeral 50 and terminating in spaced relation to each other. The inturned flanges 50 are slidingly received in vertical grooves 52 in the upper end portion of the leg body 30. The leg body 30 has parallel, planar side surfaces 54 which are closely and telescopically received between the legs of the channel-shaped section and the top surface 56 of the leg body 30 engages the undersurface of the web of the channel-shaped section. With this construction, the metal channel-shaped sections 44 and 46 are detachably connected to the legs by vertical insertion of the flanges 50 into the grooves 52, with the structure of the grooves and flanges being such that when the flanges 50 are forced inwardly into the grooves 52, they will be frictionally retained in place. Assembly of the end rails 14 can be accomplished without any specific tools inasmuch as the interlocking connection between the end of the channel-shaped section and the leg body 30 may be accomplished by merely exerting downward pressure on the web of the channel-shaped sections, such as by stepping on the upper surface thereof. The legs of the channel-shaped section 46 are swaged outwardly slightly at 47 so that all of the channel-shaped sections will have the same inner dimensions where they connect to the leg body 30.

The adjacent and telescopic ends of the sections 44 and 46 are retained in longitudinally adjusted position by a locking device generally designated by numeral 57 (FIG. 9) which is in the form of an elongated plastic strap member 58 having a generally I-shaped end member 59 rigidly affixed into the interior of the channel-shaped section 46. The free end of the plastic strap or member 58 extends downwardly through the slot defined by the inturned edges of the flanges 48 and terminates in a laterally enlarged handle 60 which underlies the flanges 48 in spaced relation thereto. The downwardly extending portion of the plastic strap 58 is provided with a shoulder 61 which forms a reduced width area which receives the inturned edges of the flanges 48 and provides a downward limit to movement of the handle 60 and the strap 58. The strap 58 adjacent the juncture with the downwardly extending portion is provided with an upstanding lock pin 62 which projects through an aperture provided in the web of the channel-shaped section 46 a sufficient distance to also extend through one of a plurality of apertures 63 formed in the web of the channel-shaped section 44. As illustrated, the apertures 63 in the channel-shaped section 44 are arranged in multiple groups of three apertures each to provide for orientation of the side rails 12 in various spaced relationships with each group of three apertures representating a standardized width and the three apertures in each group enabling the frame to be varied to accommodate variations in the standardized width of bedding produced by various manufacturers. The locking device 57 is preferably of one piece of plastic material having substantial rigidity but being sufficiently flexible and resilient and having memory characteristics capable of repeated deflection sufficient that movement of the handle 60 downwardly will disengage the pin 62 from the aperture 63 to enable adjustment of the sections 44 and 46 and complete disassembly and assembly of the channel-shaped sections 44 and 46.

Figure 6:
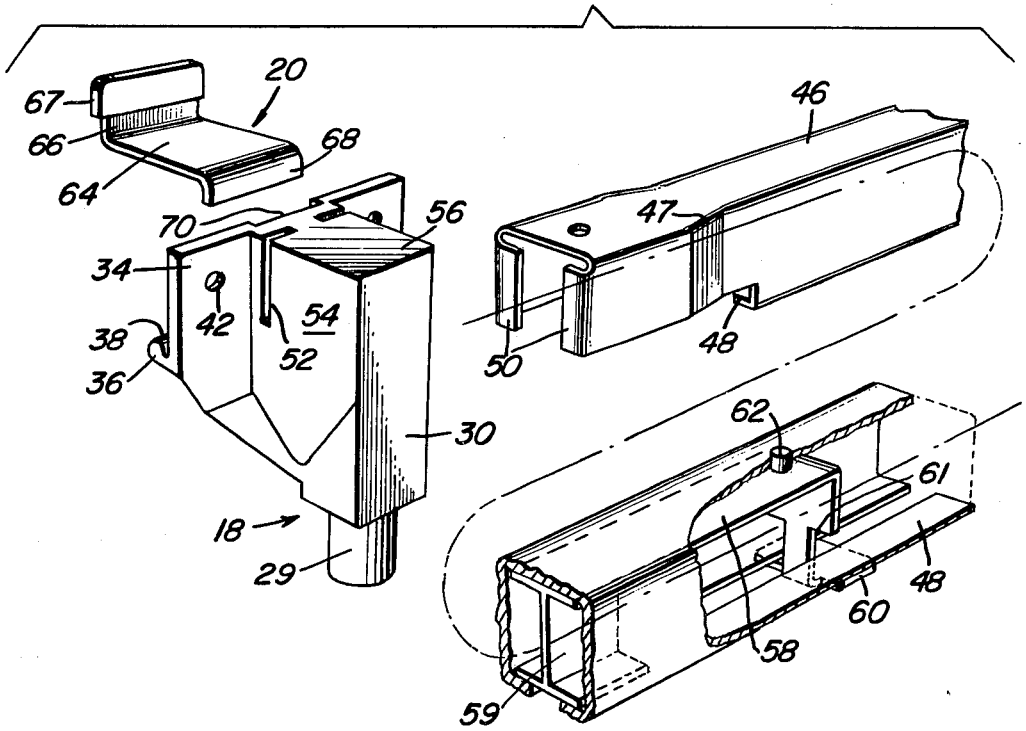
FIG. 6 is an exploded group perspective view illustrating further details of the assembly illustrated in FIGS. 4 and 5.

The box spring or bedding will be retained on the bed frame by the box spring clips 20 which are in the form of a metal strap or plate 64 which is relatively thin but substantially rigid with the plate having an upturned outer end 66 and a downwardly curved, depending inner end or tongue 68 on the inner end thereof, which is substantially the same width as the interior distance between the legs of the adjacent channel-shaped section, as illustrated in FIGS. 4 and 6. The tongue 68 extends downwardly and is telescopically and frictionally received in a downwardly extending notch or recess 70 formed in the inner surface of the leg body 30 so that it forms a socket when the flange 34 is mounted on the inner wall 24 of the rail 12. The plate 64 will rest against the upper surface of the upper flange or wall 26 of the side rail 12 as illustrated in FIG. 5. This arrangement orients the upturned end 66 outwardly of the side rail 12 so that the box spring 16 which is engaged by the upturned end 66 also will project slightly outwardly beyond the outer side edge of the side rail 12 as illustrated in FIG. 4, thus recessing the side rails and leg assemblies inwardly of the side edges of the bedding. The frictional contact between the side edges of the tongue 68 and the recess 70 which may converge slightly is sufficient to retain the box spring clips in position until the box springs 16 are positioned thereon, with the box springs subsequently retaining the box spring clips in position. The upper edge of the upturned end 66 is provided with a plastic cap 67 or may be rounded to protect the fabric covering of the box springs and the dimensional characteristics of the horizontal portion of the plate 64 as well as the upturned end portion 66 may be varied in order to provide effective retention of the box springs in overlying relation to the bed frame 10.

The end bracket assemblies 22 include a plate 72 which is vertically oriented and is in the form of an adapter plate having horizontal and/or vertical slots 74 therein for receiving fasteners therethrough for mounting a headboard and/or footboard to the frame. In certain instances, the footboard may be eliminated in which event the end bracket assemblies at one end of the bed frame will be eliminated. The plate 72 is connected to the end of the side rail 12 by a projecting triangular shaped member 76 which is telescopically and frictionally locked in the end of the tubular side rail 12. The triangular member 76 conforms in shape and configuration to the triangular side rail 12 but the apex portion between the top and inner wall is omitted so that it will closely fit telescopically into the end of the side rail 12 with the triangular member 76 being tapered slightly toward a smaller end which is initially received in the side rail 12 so that as the bracket 20 is forced toward the end of the side rail 12, the member 76 will be frictionally locked in place. Here again, suitable forces may be exerted on the plate 72 to provide for the secure anchoring engagement of the end bracket assembly. If the bed frame is to be assembled without a footboard, then one pair of end bracket assemblies may be omitted and a suitable plastic end cap (not shown) may be provided in telescopic secure engagement with the end of the side rail 12 if desired.

FIG. 2 illustrates the bed frame arranged in a manner to receive queen size bedding in which the cross rails 14 have been adjusted to be longer than in FIG. 1 and a centrally oriented cross rail generally designated by numeral 78 is employed and which includes a center section 80 and two end sections 82 which are all of channel-shaped configuration similar to sections 44 and 46. In this construction, the central portion of the center section 80 is provided with a depending supporting leg assembly 84 having a caster or glide 86 on the lower end thereof with the upper end of the leg being received between the legs of the channel-shaped center section 80 and fixedly secured thereto by any suitable fastening means, such as rivets 85. The end section 82 at each end of the center section 80 is attached to the side rail 12 by a bracket plate 88 fastened to the inner wall or flange 24 of the side rail 12 by welding as at 90 or by suitable fasteners. The vertical side edges of the plate 88 which are designated by numeral 92 are offset from the side rail 12 as illustrated in FIGS. 7 and 8 to provide vertical grooves or recesses 94 which receive the inturned flanges 96 on the end section 80 which are identical to the flanges 50 on the sections 44 and 46. The flanges 96 are frictionally engaged in the grooves 94 so that when the end sections 82 are forced downwardly, the end sections 82 and correspondingly the complete central cross rail 78 will be fixedly and rigidly connected to the central portion of the side rail 12, thus providing a fifth leg for support of the queen size bedding frame. The connection between the center section 80 and the end sections 82 of the central cross rail 78 is the same as the pin and hole connection between the telescopic sections of the end cross rails 14.

FIG. 3 illustrates the arrangement of the bed frame when supporting king size bedding. In this arrangement, the sections of the end cross rails 14' are of channel-shaped configuration and are each arranged in the same configuration as the center cross rail 78 in FIG. 2 in which a center section 98 and two end sections 100 are used. In this construction, the center section 98 of the channel-shaped cross rail 14' is provided with a leg assembly generally designated by the numeral 102 which is similar to the leg assembly illustrated in FIGS. 4–6 with the leg assembly 102 including a body 30'. In this arrangement, the body 30' includes a portion 31 which extends through a notch 99 in the channel-shaped member 98 and secured thereto by rivets 101. A longitudinally extending central rail 104 interconnects the two cross rails 14' with the central longitudinal rail 104 also being in the form of a downwardly opening channel-shaped member having the ends thereof constructed in the manner illustrated in FIG. 6, that is, with inturned side flanges for frictional detachable locking engagement with the grooves in the body 30' of the leg assembly 102. With this arrangement, by maintaining an inventory of side rails, clips, end brackets, channel-shaped sectons and channel-shaped sections having supporting legs attached thereto, a bedding retailer may select an appropriate combination of components to send to a customer along with the bed frame when delivered so that the bed frame may be easily setup to the desired width by using no tools or, at most, employing some type of instrument to impart impact forces to the telescoping, frictionally locking components. This type of implement may be in the form of a conventional hammer which is usually available in most delivery trucks or can be provided by the customer. If a positive mounting is desired for the end brackets, any suitable type of fastener may be employed or a struck-out lug and tongue arrangement may be provided for positively locking the end bracket assembly to the side rails, thus eliminating any loose fasterners.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A bed frame comprising a pair of generally parallel side rails and a pair of generally parallel cross rails oriented in perpendicularrelation to the side rails, a supporting leg assembly adjacent the extremities of the frame, and means detachably connecting the ends of the cross rails to the side rails, said detachable means comprising a pair of laterally extending, spaced, opposed vertical flanges on the end of the cross rail, said supporting leg assembly including a body having a pair of laterally opening, vertically disposed grooves having open upper ends vertically slidably receiving said flanges for rigidly and detachably connecting the cross rail with the side rail.

2. The structure as defined in claim 1 wherein said flanges terminate in facing edges defined by inturned end edges on a downwardly opening channel-shaped member, said grooves including downwardly extending portions frictionally and detachably securing the end of the cross rail rigidly to the side rail.

3. A bed frame comprising a pair of generally parallel side rails and a pair of generally parallel cross rails oriented in perpendicular relation to the side rails, a supporting leg assembly adjacent the extremities of the frame, and means detachably connecting the ends of the cross rails to the side rails, said detachable means comprising a pair of spaced, opposed flanges on the end of the cross rail, and means attached to the side rails defining a pair of vertically disposed grooves having open upper ends vertically slidably receiving said flanges for connecting the cross rail with the side rail, said means defining each pair of vertically disposed grooves being in the form of the upper end portion of one of said leg assemblies, each leg assembly including a vertically oriented body having parallel surfaces perpendicular to the side rail with the grooves being oriented in said surfaces, said cross rail having a channel-shaped configuration opening downwardly with the end edges of the vertical legs of the channel-shaped cross rail being turned inwardly to form said flanges for slidable reception in the grooves in the upper end of the leg body, said leg body including laterally extending flanges on the upper end portion thereof with the flanges and the body defining a vertically disposed, substantially flat surface engaged with the side rail, and fastening means extending between the leg body and the side rail for rigidly securing the leg body to the side rail, said side rail being of right triangular configuration including perpendicularly arranged top and inner walls with the top wall being horizontally disposed and the inner wall vertically disposed and engaging the flat surface on the leg body, the inner surface of the leg body including a projecting flange angulated upwardly in spaced relation to the upper edge of the leg body to receive the lower edge of the side rail for preventing lateral movement of the leg body in relation to the side rail.

4. The structure as defined in claim 3 together with box spring retaining clips attached to each of said side rails adjacent the ends thereof with each of the clips being aligned with a cross rail, each of said box spring clips including a substantially flat horizontally disposed plate overlying the top wall of the side rail and projecting laterally outwardly therefrom and terminating in an upstanding outer end for engaging the outer side surface of a box spring, the inner edge of the horizontal plate including a depending tongue thereon, the upper end of said leg body including a vertical notch on the inner surface thereof in facing relation to the side rail and combining with the side rail to form a socket telescopingly receiving the depending tongue for mounting the clip on the leg body and side rail with the side rail and leg body being spaced inwardly from the side edge of the box spring.

5. The structure as defined in claim 3 wherein said leg body is constructed of unitary plastic construction with the opposing edges of the flanges on the cross rails and the inner edges of the grooves being in frictional locking interengagement.

6. The structure as defined in claim 3 wherein end brackets are provided on at least one end of each side rail, each of said end brackets including a vertically disposed mounting plate and a triangular projection thereon shaped and conformed with the triangular side rail and telescopically received and anchored therein by frictional engagement.

7. The structure as defined in claim 3 together with a centrally disposed cross rail between the two side rails and interconnecting the central portion of the side rails, a central portion of the central cross rail including a depending leg assembly, and means detachably connecting the ends of the central cross rail to the side rails, said means comprising a bracket attached to the central portion of each side rail and including outwardly offset flanges to define vertical grooves receiving opposed flanges on the central cross rail.

8. The structure as defined in claim 3 wherein each of the end cross rails includes a centrally disposed depending leg assembly, a longitudinally extending centrally disposed rail paralleling the side rails, and means detachably interconnecting the ends of the centrally disposed rail and the end cross rails, said means including a vertically interlocking connection between each end of the centrally disposed longitudinal rail and the leg assembly supported from the central portion of the end cross rail.

9. In a bed frame having a pair of side rails interconnected by a pair of cross rails, that improvement comprising the side rails being constructed of a one-piece tubular seamless member of right triangular configuration, said tubular side rail including a substantially horizontally disposed top wall for supporting a box spring, a substantially vertically disposed inner wall and a diagonal outer wall interconnecting the lower edge of the inner wall and the outer edge of the upper wall to provide a rigid, closed side rail void of lower, outer corner edges.

10. The structure as defined in claim 9 combined with insertable end brackets having a vertically disposed plate adapted to be connected to a headboard or footboard and a triangular projection telescopically received in the triangular side rail and including conforming, tapering surfaces for frictionally locking the projection and vertical plate to the side rail.

11. In a bed frame having a pair of side rails and sectional cross rails, said cross rails being of downwardly opening channel-shaped configuration, and leg assemblies supporting said frame, that improvement comprising a one-piece locking device locking the sections of the cross rails in telescopic, adjustable and detachable relation to enable set-up and adjustment of the frame, said locking device including a plastic member in the form of a flexible and resilient strap underlying the web of one channel-shaped section and provided with a projecting pin extending through a hole in said web and through a selected hole of a plurality of holes in the overlying web of a channel-shaped section telescoped over said channel-shaped section, said strap having a depending free end extending below the channel-shaped members and terminating in a handle to move said pin out of engagement with the holes, and an enlarged end member on the strap remote from the handle for substantially completely filling the channel-shaped section and anchoring the strap thereto in close underlying relation to the web.

12. The structure as defined in claim 11 wherein said channel-shaped sections have inturned flanges on the lower edges of the legs, said strap including a depending portion extending between the inturned flanges with the handle located below said flanges, the depending portion of the strap having a shoulder thereon to limit the downward deflection of the strap to limit the downward movement of the pin and prevent the strap from being deflected beyond its elastic limit.

13. In a bed frame having a pair of telescopically engaged tubular cross rail sections, that improvement comprising a one-piece locking device locking the sections of the cross rail in telescopic, adjustable and detachable relation to enable set-up and adjustment of the frame, said locking device including an elongate flexible and resilient strap underlying the interior longitudinal surface of one tubular section and provided with a projecting pin extending through a hole in said longitudinal surface and through a selected hole of a plurality of holes in an overlying longitudinal surface of a second tubular section telescoped over said one tubular section, said strap having a laterally extending free end extending outwardly of the tubular sections and terminating in a handle, said pin being disposed adjacent the free end of said strap and moving out of engagement with the holes when the handle is moved laterally to enable telescopic adjustment of said sections, and means anchoring the end of the strap remote from the handle in close underlying relation to the longitudinal surface of said one tubular section.

14. A bed frame comprising, in combination:

a. a pair of side rails;
b. a rigid supporting leg assembly adjacent each end of each side rail;
c. a pair of cross rails;
d. a pair of upwardly opening laterally spaced grooves on each supporting leg assembly; and
e. a pair of vertical, laterally spaced rigid flanges on each end of each cross rail received in said grooves in a vertical sliding relationship for rigidly and detachably securing the cross rails to the leg assemblies.

15. The bed frame as defined in claim 14 wherein each leg assembly includes a body extending laterally inwardly of the side rail, said body including generally parallel opposed surfaces, said grooves being disposed in said surfaces, said flanges on the end of the cross rail extending inwardly towards each other and slidably received in said grooves, each end of the cross rail having parallel, inwardly facing surfaces slidably engaging the parallel surfaces on the body to substantially preclude rocking movement between the cross rails and side rails.

16. The bed frame as defined in claim 14 wherein each side rail includes a horizontal top flange and a vertical inner flange, each leg assembly including a body having a mounting surface secured to said inner flange, the lower portion of said mounting surface having an upwardly and outwardly extending projection defining a recess receiving the lower edge of the inner flange of the side rail.

17. The bed frame as defined in claim 16 wherein said side rail is a one-piece, right triangular tubular member, said projection on the leg body being hook-like and extending continuously along the lower portion of the mounting surface.

18. The bed frame as defined in claim 14 wherein each side rail includes a horizontal top flange and a vertical inner flange, each leg assembly including a body secured to the inner flange and having a top surface extending inwardly from the top flange of the side rail in generally aligned relation thereto, said top surface of the leg body having a vertically opening socket therein, and a spring retaining clip including a narrow strap extending transversely against the top flange of the side rail and provided with a downwardly extending tongue on the inner portion thereof vertically slidably received in said socket in the leg body and an upstanding member on the outer portion thereof adapted to extend along the outer edge of a bed spring to retain the bed spring aligned with the bed frame.

* * * * *